US008459815B2

(12) United States Patent
Hunt et al.

(10) Patent No.: US 8,459,815 B2
(45) Date of Patent: Jun. 11, 2013

(54) STAGE LIGHTING LAMP UNIT AND STAGE LIGHTING SYSTEM INCLUDING SUCH UNIT

(75) Inventors: Mark A. Hunt, Derby (GB); Keith J Owen, Moseley (GB); Michael D Hughes, Wolverhampton (GB)

(73) Assignee: Production Resource Group, L.L.C, New Windsor, NY (US)

( * ) Notice: Subject to any disclaimer, the term of this patent is extended or adjusted under 35 U.S.C. 154(b) by 0 days.

(21) Appl. No.: 13/154,583

(22) Filed: Jun. 7, 2011

(65) Prior Publication Data

US 2011/0299278 A1 Dec. 8, 2011

Related U.S. Application Data

(60) Continuation of application No. 11/857,404, filed on Sep. 18, 2007, now Pat. No. 7,954,966, which is a division of application No. 11/127,975, filed on May 11, 2005, now Pat. No. 7,270,444, which is a continuation of application No. 10/625,465, filed on Jul. 22, 2003, now Pat. No. 6,894,443, which is a continuation of application No. 10/007,008, filed on Dec. 4, 2001, now Pat. No. 6,597,132, which is a continuation of application No. 09/313,418, filed on May 17, 1999, now Pat. No. 6,326,741, which is a division of application No. 08/994,036, filed on Dec. 18, 1997, now Pat. No. 5,921,659, which is a continuation of application No. 08/756,211, filed on Dec. 21, 1995, now Pat. No. 5,788,365, which is a division of application No. 08/077,877, filed on Jun. 18, 1993, now Pat. No. 5,502,627.

(30) Foreign Application Priority Data

| | | |
|---|---|---|
| Sep. 25, 1992 | (GB) | 9220303.3 |
| Sep. 25, 1992 | (GB) | 9220309.0 |
| Apr. 20, 1993 | (GB) | 9308071.1 |

(51) Int. Cl.
*F21V 33/00* (2006.01)

(52) U.S. Cl.
USPC ..... 362/85; 362/233

(58) Field of Classification Search
USPC ..... 362/85
See application file for complete search history.

(56) References Cited

U.S. PATENT DOCUMENTS

| | | | | |
|---|---|---|---|---|
| 3,731,177 | A | 5/1973 | Commander et al. | |
| 4,392,187 | A * | 7/1983 | Bornhorst | 362/233 |

(Continued)

FOREIGN PATENT DOCUMENTS

| | | |
|---|---|---|
| EP | 0 495 305 | 7/1992 |
| FR | 2 643 134 | 8/1990 |

(Continued)

OTHER PUBLICATIONS http://dictionary.reference.com/browse/represent.

*Primary Examiner* — William Carter
(74) *Attorney, Agent, or Firm* — Law Office of Scott C. Harris, Inc.

(57) ABSTRACT

A stage lighting lamp unit includes a processor for receiving control data from a remote console. Beam orientation data for the lamp unit is passed to the lamp in the form of the x, y and z co-ordinates of a point in space through which the beam is to pass. The processor divides the required lamp travel into a number of stages dependent on execution duration data sent with the position data, and calculates, for each stage, a new value for pan and tilt angles for the lamp. These values are passed to pan and tilt controlling co-processors which control servo-motors for pan and tilt operation. The lamp unit also incorporates a rotatable shutter for interrupting the lamp beam when required. The shutters of all the lamps in a system can be instructed from the remote console to open and close in synchronism, thereby providing a stroboscopic effect.

18 Claims, 10 Drawing Sheets

U.S. PATENT DOCUMENTS

| | | | | | |
|---|---|---|---|---|---|
| 4,716,344 | A | * | 12/1987 | Newell et al. | 362/418 |
| 4,837,665 | A | | 6/1989 | Hoyer et al. | |
| 4,890,208 | A | | 12/1989 | Izenour | |
| 4,945,459 | A | | 7/1990 | Ferren et al. | |
| 4,980,806 | A | | 12/1990 | Taylor et al. | |
| 5,005,162 | A | | 4/1991 | Mitsumori et al. | |
| 5,010,459 | A | | 4/1991 | Taylor et al. | |
| 5,045,983 | A | | 9/1991 | Shields | |
| 5,209,560 | A | * | 5/1993 | Taylor et al. | 362/85 |
| 5,414,328 | A | | 5/1995 | Hunt et al. | |
| 5,414,601 | A | | 5/1995 | Davenport et al. | |
| 5,502,627 | A | | 3/1996 | Hunt et al. | |
| 5,588,021 | A | | 12/1996 | Hunt et al. | |
| 5,769,531 | A | | 6/1998 | Hunt et al. | |
| 5,788,365 | A | | 8/1998 | Hunt et al. | |
| 5,921,659 | A | | 7/1999 | Hunt et al. | |
| 6,326,741 | B1 | | 12/2001 | Hunt et al. | |

FOREIGN PATENT DOCUMENTS

| | | |
|---|---|---|
| GB | 2 209 229 | 5/1989 |
| GB | 2 231 138 | 11/1990 |
| WO | 89 05421 | 6/1989 |

* cited by examiner

STAGE LIGHTING LAMP UNIT AND STAGE LIGHTING SYSTEM INCLUDING SUCH UNIT

CROSS-REFERENCE TO RELATED APPLICATIONS

This application is a continuation of Ser. No. 11/857,404 filed Sep. 18, 2007, which is a divisional application of and claims priority to U.S. patent application Ser. No. 11/127,975, filed May 11, 2005, now U.S. Pat. No. 7,270,444; which is a continuation of U.S. patent application Ser. No. 10/625,465, filed Jul. 22, 2003, now U.S. Pat. No. 6,894,443; which is a continuation of U.S. patent application Ser. No. 10/007,008, filed Dec. 4, 2001, now U.S. Pat. No. 6,597,132; which is a continuation of U.S. patent application Ser. No. 09/313,418, filed May 17, 1999, now U.S. Pat. No. 6,326,741; which is a divisional of U.S. patent application Ser. No. 08/994,036, filed Dec. 18, 1997, now U.S. Pat. No. 5,921,659; which is a continuation of U.S. patent application Ser. No. 08/576,211, filed Dec. 21, 1995, now U.S. Pat. No. 5,788,365; which is a divisional of U.S. patent application Ser. No. 08/077,877, filed Jun. 18, 1993, now U.S. Pat. No. 5,502,627; which claims the benefit of Great Britain Application Serial No. 9220303.3, filed Sep. 25, 1992, Great Britain Application Serial No. 9220309.0, filed Sep. 25, 1992, and Great Britain Application Serial No. 9308071.1, filed Apr. 20, 1993. The disclosures of the prior applications are considered part of (and are incorporated by reference in) the disclosure of this application.

BACKGROUND

This invention relates to stage lighting and is particularly concerned with the control of multiple functions of a lamp.

SUMMARY

It has already been proposed to incorporate in a lamp unit a plurality of different functions, such as colour changers, focusing lenses, iris diaphragms, gobo selectors and pan and tilt mechanisms which are controlled from a remote console. Stage lighting systems have as a result reached very high levels of complexity requiring a very complicated main control console and lamp unit constructions. The use of microprocessors, both in the console and the lamps bas become conventional as increasing complexity makes it more difficult to produce and subsequently maintain a system which uses hard wired logic or analog controls. In such systems the microprocessor in the console is used to allow the user to set up lighting cues and to control the sending of appropriate data to the lamp microprocessors. The lamp microprocessors are also involved in controlling communication between the console and the lamps, and also have to control a plurality of serve motors which drive the various functions of the lamps.

It is one object of the present invention to provide a lamp micro-processor and servo-control arrangement which allows complex functions to be carried out.

It is another object of the invention to provide a lamp control system in which control of pan and tilt movements of each lamp can be carried out in rapid and efficient manner, enabling large groups of lamps to make coordinated movements.

It is yet another object of the invention to provide each lamp in a stage lighting system with a means for quickly interrupting its light beam and quickly re-establishing the beam so that a group of lamps can be made, when required to flash in synchronism.

In accordance with one aspect of the invention there is provided a lamp unit for connection to a remote control console for the control of a plurality of different functions of the lamp, said unit comprising a main processor circuit, associated with a communication controller for accepting message data from the console, a plurality of servo-controls for operating said functions of the lamp, and a plurality of co-processors which are connected to the main processor circuit so as to be supplied thereby with desired value data for the various lamp functions, said servo-controls being controlled by said co-processors.

In the case of pan and tilt controls where close control is required throughout the movement of the lamp from an initial position to a new position, one of the co-processors is assigned solely to the control of movement about each axis. Other functions can share a co-processor.

The main processor circuit of the lamp is preferably programmed to accept data from the control console defining not only a target position for any function, but also a duration over which the function is to be executed. In this case the main processor circuit divides the "journey" into segments and updates the target position data passed to the associated co-processor at intervals.

In accordance with another aspect of the invention, there is provided a lighting control apparatus comprising the combination of a main control console for accepting user input relating to required beam movements, a plurality of independently operable lamp units situated remotely from the console, each of the lamp units incorporating a servo-mechanism for automatically moving the lamp beam about two mutually transverse axes to a desired angular position and data communication means connecting the console to the lamp units for the transmission of desired position data to the lamp units, the desired position data being transmitted in the form of a set of three dimensional linear co-ordinates defining a point in space through which the lamp beam is required to pass, and each lamp unit including a calculating device for calculating the desired angular position from the desired position data and supplying the servomechanism with such desired angular position.

In addition to the "point at" mode of operation mentioned above, additional modes may be specified in which the lamps point away from the specified point or in which they all point in the same direction parallel to a line between a fixed position in the co-ordinate system and the specified point.

Conveniently, all the data concerning the positions and orientations of the individual lamp units within the co-ordinate system is stored in a set-up file kept on a hard disk drive in the console. When the same lighting set-up is used at different venues, where it is impossible to set the frame which carries all the lamp units at exactly the same position as that for which the set-up was designed, offset data can be input at the console and either used within the console microcomputer to correct the position data stored during set-up as it is sent out, or such data can be sent to all or the lamp units over the network and stored there, to enable the corrections to be made in the individual lamp processor units.

In accordance with another aspect of the invention, a stage lighting unit comprises a housing, a light source within said housing, an optical system for forming light from said light source into a beam, a rotary shutter device having a plurality of blades, said shutter device being rotatably mounted in the housing so as to cause said blades to pass through and obstruct said beam as the shutter device rotates, a motor for rotating said shutter device and a servo-control for controlling said motor in accordance with data received in use from a remote control console.

The invention also resides in a stage lighting system incorporating a plurality of lighting units as defined above controlled by a common remote control console via data communication means, whereby the rotary shutter devices of all the units can operate in synchronism.

An example of the invention will now be described with reference to the accompanying drawings, in which:

BRIEF DESCRIPTION OF THE DRAWINGS

FIGS. 4 to 7 are detailed circuit diagrams showing a rotary shutter motor drive control forming part of the internal circuitry of the lamp;

DESCRIPTION

Figure 1:
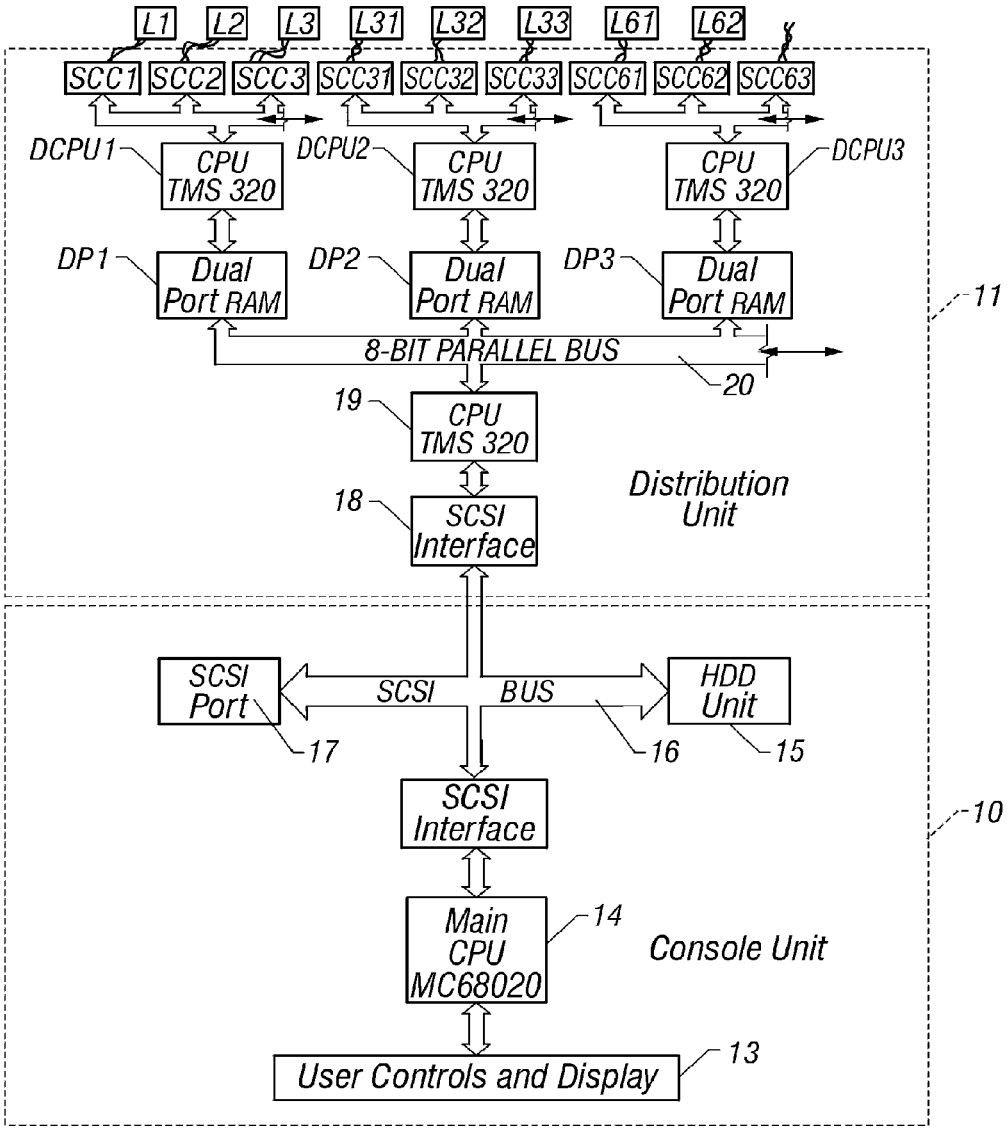
FIG. 1 is a block diagram of a stage lighting system.

Referring firstly to FIG. 1, the system consists basically of a console unit 10; a signal distribution unit 11 and a plurality of lamps L1, L2, L3 . . . , L31, L32, L33 . . . , L61, L62 . . . individually connected by twisted pair data communication links to the distribution unit.

The console unit 10 has an array of switches, slider potentiometers, rotary digital encoders and other user actuable input devices (not shown) and a display indicated at 13. These are all connected to main console cpu 14 (an MC68020 micro-processor) which has the task of receiving inputs from the user actuable input devices and controlling the display. Both tasks are assisted by separate co-processors which directly interface with different parts of the console.

The main cpu can communicate with a hard disk drive unit 15 via a SCSI bus 16 which also connects it to the distribution unit and to an external SCSI port 17, through the intermediary of which the console can, if required be connected to a personal computer. The user controls can be used in setting up a sequence of cues in advance of a performance, the sequence being stored in a cue file on the hard disk drive unit 15. The sequence can be recalled during the performance to enable the various stored cues to be executed. Direct manual control of the lamps from the console is also possible as is manual editing of cues called up from the hard disk. The main console cpu 14 creates messages to be sent to the individual lamps, each message comprising a fixed number of bytes for each lamp. The messages contain data relating to the required lamp orientation, beam coloration, iris diaphragm diameter, gobo selection and rotation, zoom projection lens control and opening or closing of a shutter included in the lamp. A block of the RAM of the main cpu is set aside for the storage of these messages, the block being large enough to contain messages for 240 lamps, being the largest number which can be controlled via the distribution unit. Where it is required to control more than 240 lamps additional distribution units can be connected to the SCSI bus and extra main cpu RAM reserved for message storage. When any message data is changed the main cpu 14 sets a flag in the RAM block which is detected at a given point in the main cpu program loop and interpreted as a signal that the changed message data is to be transferred to the distribution unit 11.

The distribution unit 11 has a main cpu 19 which controls reception of data from the SCSI bus interface and distribution of such data to up to eight blocks of dual, port memory DP1, DP2, DP3 . . . via an eight bit data bus 20. The cpu 19 is alerted to the waiting message data when cpu 14 selects the distribution unit. The cpu 19 then supervises byte by byte transfer of the message data which it routes to the various blocks of dual port memory.

For actually sending out the message data to the lamps, there are a plurality of serial communication controllers SCC1 to SCC30, SCC31 to SCC60 etc, there being thirty serial communication controllers associated with each block of dual port memory. A further cpu DCPU1, DCPU2, etc is associated with each block of dual port memory and distributes message data transferred to the dual port memory to the individual serial communication controllers and the messages are transferred to the lamps. Each serial communication controller in the distribution unit includes a line driver which can be disabled except when data is to be transmitted. Enabling of the driver can cause a spurious signal to be transmitted over the data link. To allow such spurious signals to be identified and ignored, a two-byte gap is left between enabling the line driver and commencing transmission of the message data for the channel in question.

This will be described in more detail herein. All asynchronous serial communication systems require framing information to synchronize the reception process. This has been typically done in the prior art using start bits and stop bits.

The present invention preferably uses FM0 coding in which the data is transmitted as one cycle of the carrier frequency for a zero or as a half cycle of the carrier frequency for a one. When the line has been idle, no waveform at all is present. When the line drivers are first enabled, an arbitrarily short pulse will usually appear on the line, due to lack of synchronization between the data signal and the enabling signal. This short data pulse could be misinterpreted as a start bit, for example and if so it would disturb later framing.

The present invention avoids any problems from this arbitrarily short pulse. To avoid this, the present invention uses a timer on the receive line, set to the time needed to receive two bytes on the serial data line. This timer is restarted whenever a byte on the data line is detected.

Each time the timer interrupt occurs, the number of bytes received is checked against the number of bytes in a valid data frame. If the number is incorrect, then the count is cleared and the message is discarded. If correct, the information is passed to the main program loop by setting a flag variable.

When the data line is first enabled, the distribution box has an internal delay of at least two byte times, which must elapse before any data will be sent. Any data received by the lamp will therefore be discarded as noise by the timer interrupt routine. After that, the real data can be safely sent down the line since the start bit of the first byte will be received correctly. When the transmission is completed, the line drivers will be disabled again.

Each of the cpus eg DCPU1, transfers data from the associated dual port RAM DP1 to the serial communication controller SCC1 to SCC30 with which it is associated one byte at a time, ie the first byte for SCC1 is transferred followed by the first byte for SCC2 and so on, each serial communication controller commencing transmission as soon as it has received its byte of data. The serial communication controllers operate to transmit data at 230.4 Kbps so that it takes about 35.mu.s to transmit each byte. Transfer of data from the dual port RAM DP1 to the serial communication controllers is, however, at a rate of several Mbps, so that the transmissions from all the serial communication controllers are almost simultaneous. The cpu DCPU1 is not required to monitor the transmission of data by the serial communication controller, but utilizes a software timer to commence transfer of the second byte to the serial communication controllers. This timer is started when transfer of the byte of data to the last serial communication controller SCC30 has been completed and its time-out duration is slightly longer than the byte transmission time, say 40.mu.s. Transmission of all the messages takes about 1.5 ms out of a distribution unit main program loop duration of 4 ms.

Figure 2:
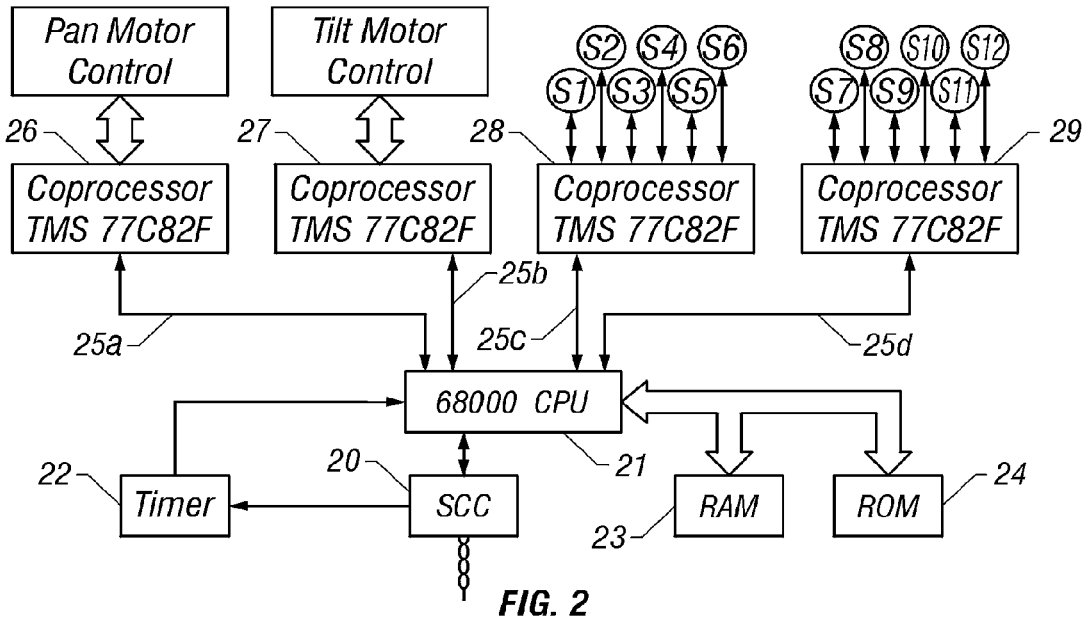
FIG. 2 is a block diagram of the internal circuitry of one of a plurality of lamp units in the system of FIG. 1.

As shown in FIG. 2, each lamp includes a serial communication controller 20 which controls reception of message data from the individual data link connecting it to the distribution unit 11. The receipt of any signal from the data link causes an interrupt of the lamp main cpu 21 (another MC68000) and the cpu 21 then controls acceptance of the signals. A timer 22 times the gaps between bytes received from the data link and this timer causes another interrupt on timeout. The time-out time of the timer is between the times taken to transmit 1 and 2 bytes, so that time out always occurs following a spurious signal caused by line driver enabling. The time-out interrupt causes the cpu 21 to inspect the total number of bytes received since the initial interrupt and if this is less than the expected number of bytes (which is constant) the message is ignored. The timeout interrupt also resets a software data pointer to the beginning of a receive buffer in readiness for the next transmission.

The cpu 21 operates in accordance with programs stored in the lamp cpu ROM. On receipt of a message of valid length, a program variable representing the number of messages received since the lamp program was last started is incremented and the main program loop of the lamp cpu checks this variable every 16 mS. If the variable has changed since the last check, the data in the receive buffer is compared with corresponding values of variables representing current "desired values" of the various lamp function parameters. For example the receive buffer may contain two bytes representing the x, y and z co-ordinates of a point in an orthogonal three dimensional frame of reference, through which point it is required that the axis of the lamp beam should be directed. If the values of the corresponding byte pairs in the receive buffer and the desired value variables already contained in the cpu RAM are the same, no action is taken in respect of the control of the motors which control pan and tilt action of the lamp (to be described in more detail hereinafter).

As shown in FIG. 2, the main lamp cpu 21 communicates via serial data links 25*a*, 25*b*, 25*c* and 25*d* with four servo-control co-processors 26, 27, 28 and 29. Each of these co-processors is a TMS77C82 cpu. Co-processors 26 and 27 respectively control pan and tilt operation, and each of the co-processors 28 and 29 can control up to six different dc servo-motors operating different functions of the lamp.

Figure 8:
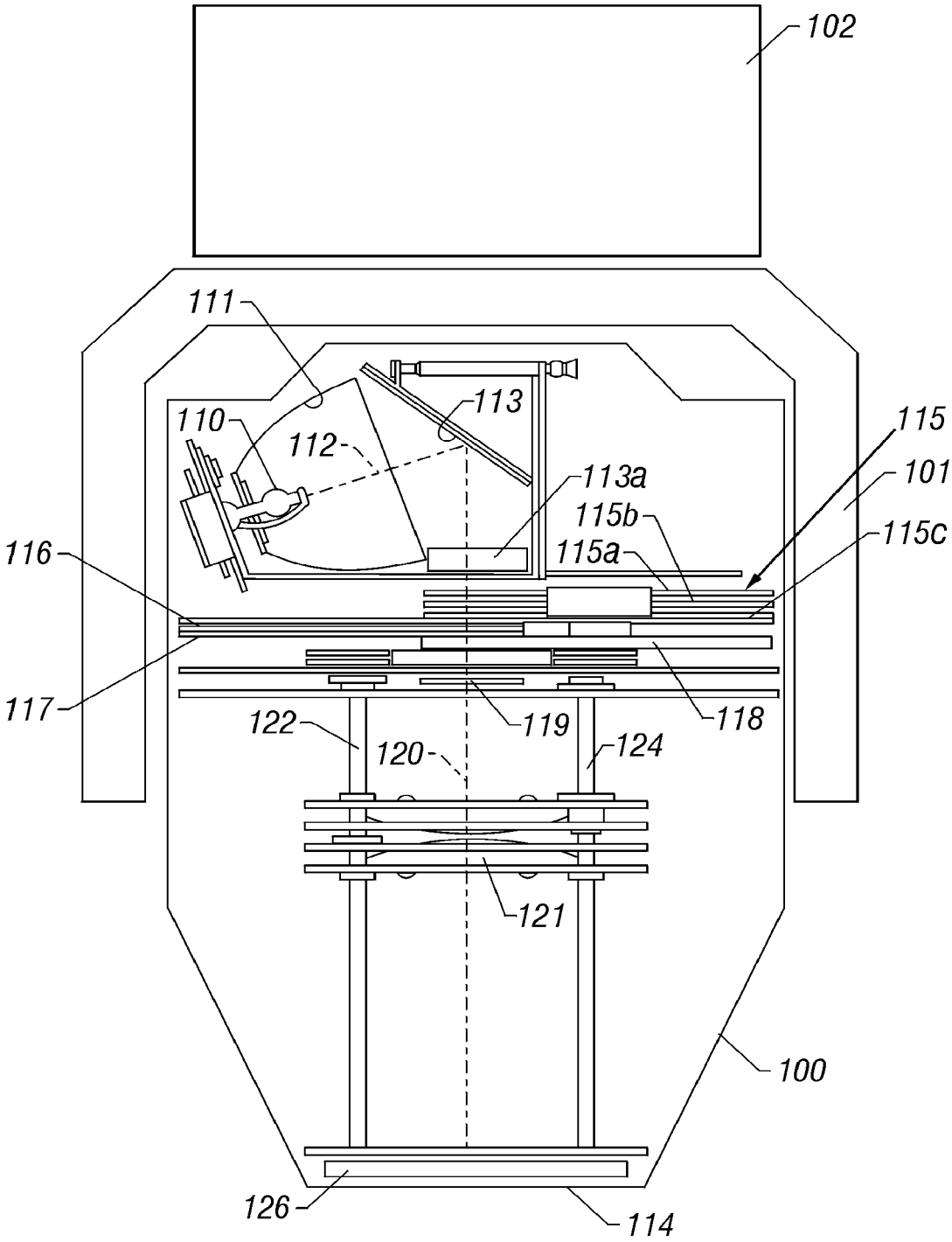
FIG. 8 is a diagrammatic, part-sectional view of one of the lamps.
Figure 9:
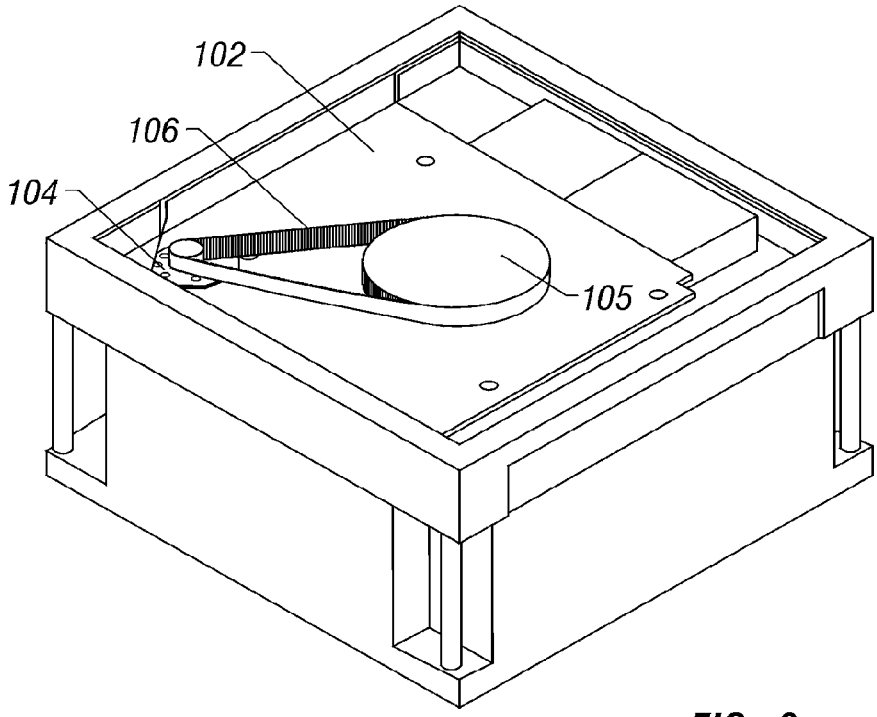
FIG. 9 is a perspective view of a pan movement drive arrangement.
Figure 10:
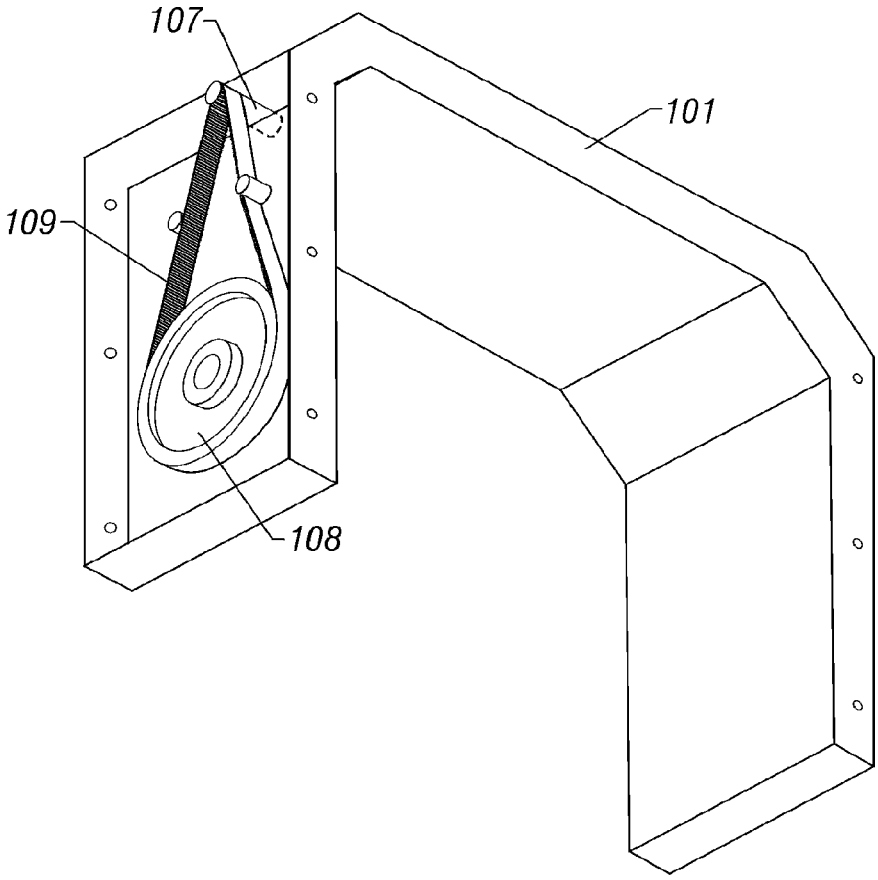
FIG. 10 is a perspective view of a tilt movement drive arrangement.

Before proceeding with a more detailed description of the circuitry and operation of the lamp electronics, some detail will be given of the various functions of the lamp. FIG. 8 shows the relative positions of a plurality of independently operable beam characteristic control elements within the lamp housing 100. The lamp housing is pivotally mounted on a U-bracket 101, which is itself pivotally mounted on a mounting base 102. FIG. 9 shows the mounting base 102 which incorporates a pan drive motor/gearbox/optical encoder arrangement 104 which drives a gear 105 attached to the U-bracket via a reduction toothed belt drive 106. FIG. 10 shows how, within the hollow structure of the U-bracket 101, there is mounted a tilt drive motor/gearbox/optical encoder 107 which drives a gear 108 attached to the lamp housing via another reduction toothed belt drive 109.

Figure 11:
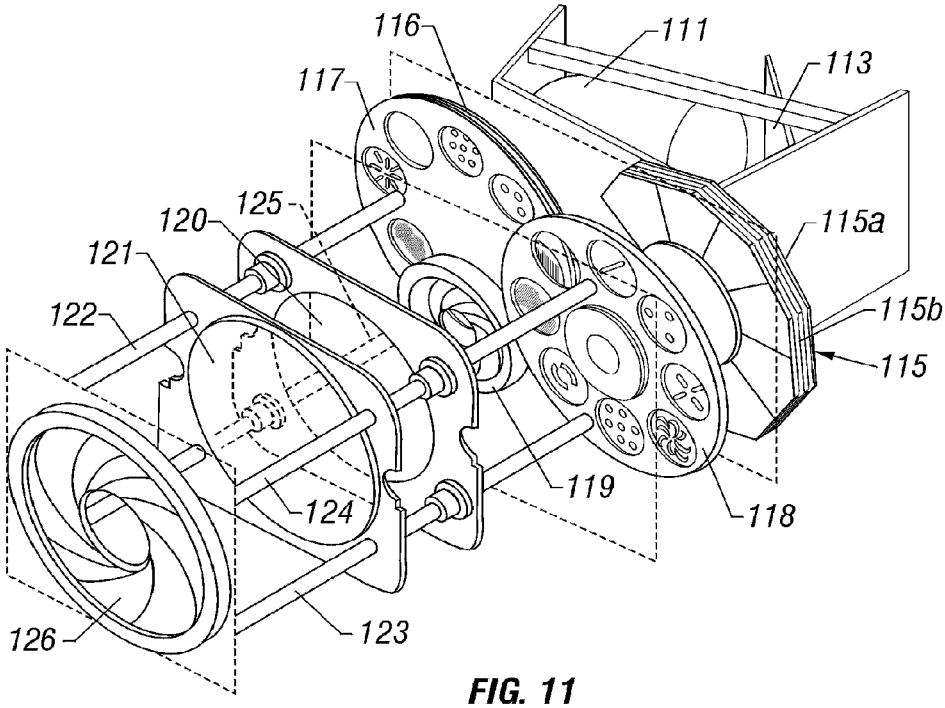
FIG. 11 is a diagrammatic perspective view of the internal moving parts or the lamp.
Figure 13:
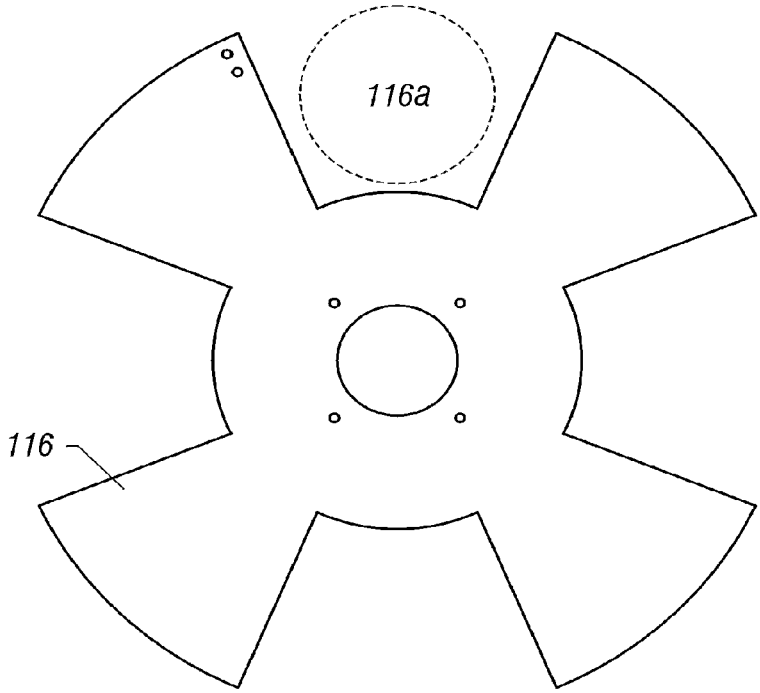
FIG. 13 is an elevation of a shutter wheel forming part of the lamp.
Figure 12:
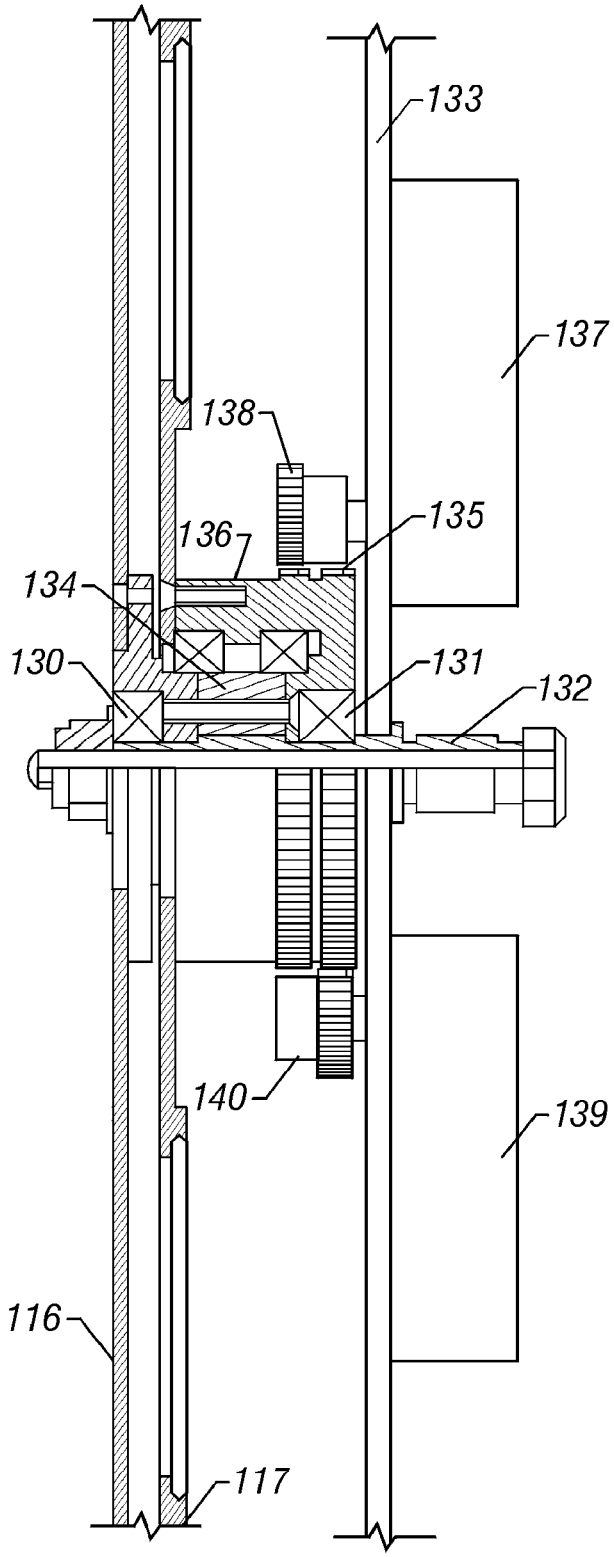
FIG. 12 is a sectional view showing the drive arrangement for a shutter and a gobo wheel forming part of the lamp.

As shown in FIGS. 8 and 11, within the lamp housing, a light source 110 is mounted within an ellipsoidal reflector 111 providing a light beam with an axis 112 which is reflected by a mirror 113, which is a dichroic mirror that reflects only visible light and passes ultra violet and infra red light, the reflected light passing out through an opening 114 at the opposite end of the housing. The reflector 111 has a generally cup shape surrounding the bulb 110. According to one aspect of the invention, the axis 112 has an angle pointing in a direction rearward relative to a perpendicular to the central axis 120 of the lamp unit. If the reflector is located as shown, such that an outside edge of the reflector is generally parallel to a rear end of the housing, the optimal packing efficiency is achieved. As shown in FIG. 8, this allows the reflector to be most efficiently packed into the available space. The reflected beam from the mirror 113 passes firstly through a collimating lens 113*a*, and then the colour changer 115 which comprises dichroic filters having differing transmission characteristics mounted on co-centered three filter disks 115*a*, 115*b* and 115*c* rotable around a common axis of rotation. Each disk has nine different filters on it and one blank space around its periphery, so that up to 1000 different combinations of filters can be positioned across the beam by selective positioning of the three disks (although not all of these combinations are necessarily useful as some may block all visible light). The blank space of each of the disks can be used to eliminate any color changing characteristic of that disk. These disks are driven by three of the dc servo-motors. Next the light beam passes through the plane of a bladed shutter 116 (shown in FIG. 13) and a first gobo wheel 117 which has various gobos mounted in or over circular holes therein. As shown in FIG. 12 described in more detail hereinafter, two motors are committed to driving the shutter 116 and the gobo wheel 117 respectively. Next, there is a second gobo wheel 118 on which there are mounted a plurality of gobos which are rotatable relative to the wheel 118. There is one motor (not shown) for driving the gobo wheel 118 and another for rotating the gobos mounted thereon through a gear arrangement (not shown). Next along the light beam is a beam size controlling iris diaphragm 119 driven by another motor (not shown). Two further motors (not shown) drive two lens elements 120, 121 along guides 122, 123 parallel to the beam axis using lead screws 124, 125. The lens elements form a simple two element zoom lens controlling the spread and focus of the beam. Finally, an outer iris diaphragm 126 is provided adjacent the opening 114 and this is driven by a further motor (not shown). In the example described, therefore only eleven channels are actually employed.

Referring now to FIG. 12, the shutter 116 is rotatably mounted on bearings 130, 131 on a shaft 132 fixed to a mounting panel 133 which is secured to the housing. The gobo wheel 117 is rotatably mounted on bearings on a tubular shaft 134 which acts to space the shutter 116 from a first drive gear 135. The gobo wheel 117 is actually mounted on a second drive gear 136. The shutter motor 137 (which is combined with a reduction gearbox and an optical encoder) is mounted on the panel 133 and drives a pinion 138 meshed with the first gear 136. Similarly motor 139 drives a pinion 140 meshed with the second gear 136. The shutter has four blades arranged symmetrically around its axis, with the blades and the gaps between them each subtending 45 degrees at the axis. The blades and the gaps between them are wide enough to block or clear the entire cross-section of the beam, shown in FIG. 13 at 116*a*.

Figure 3:
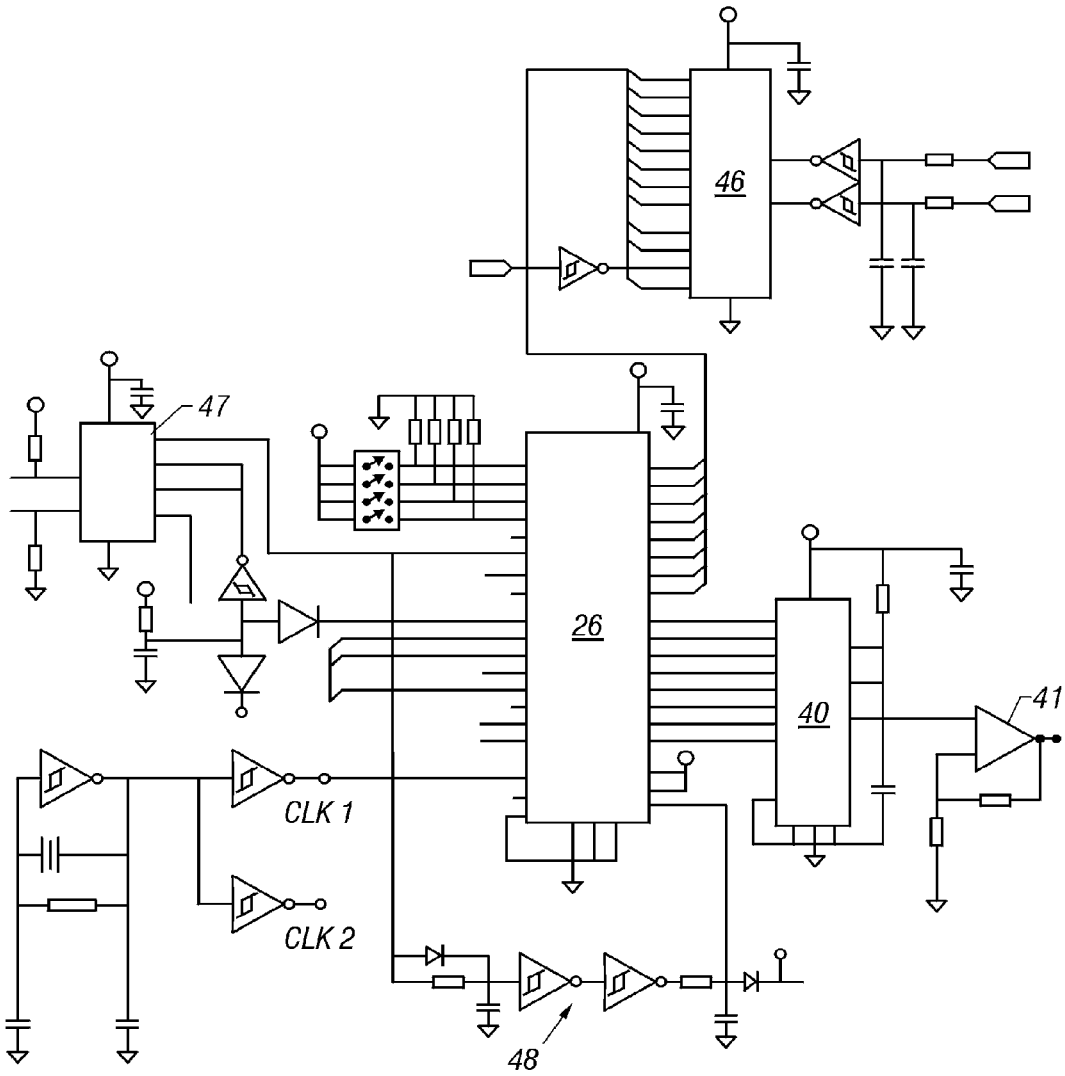
FIGS. 3 and 4 are more detailed circuit diagrams showing a pan motor drive control forming part of the internal circuitry of the lamp.
Figure 4:
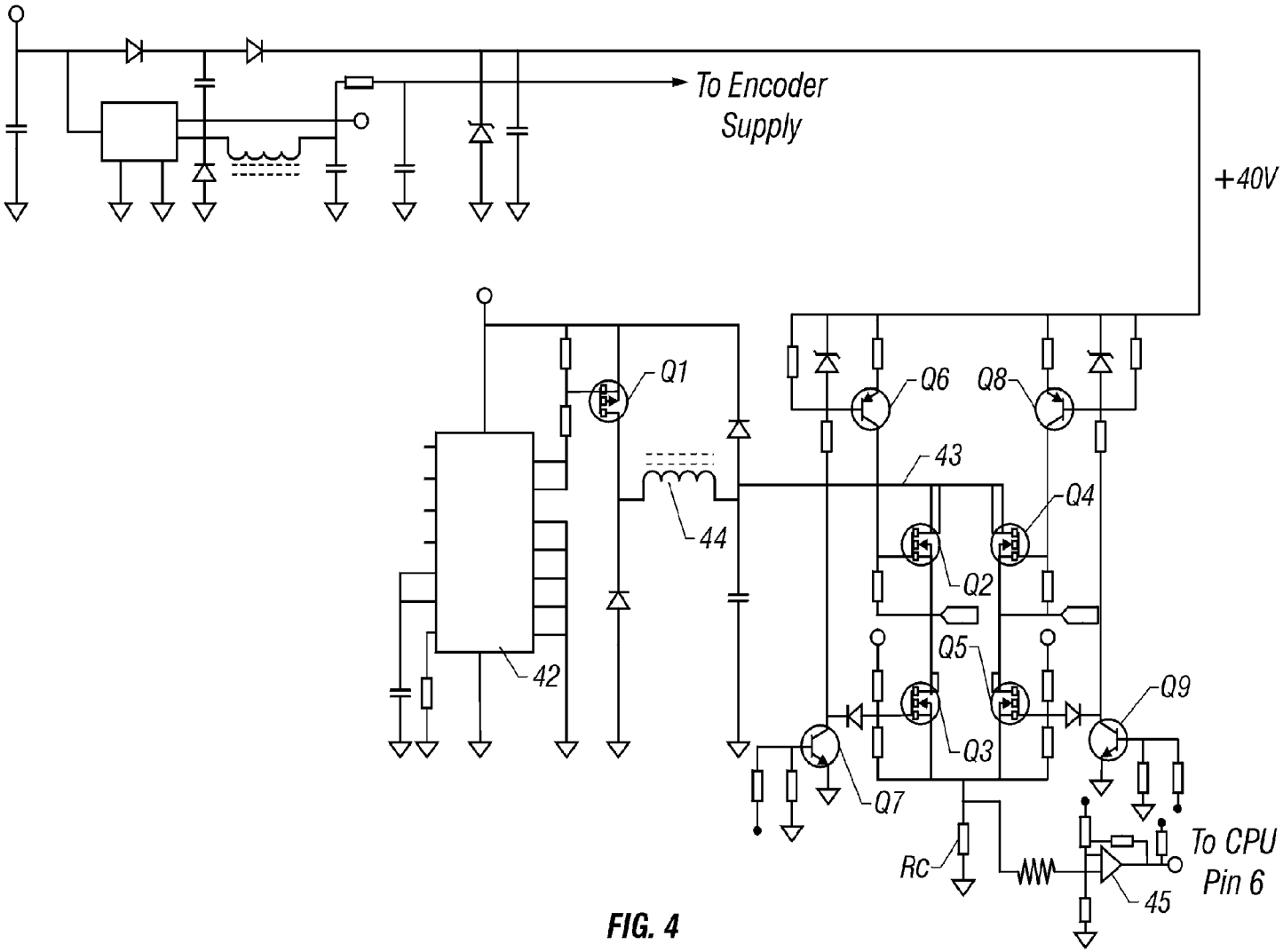

Turning now to FIGS. 3 and 4, the coprocessor 26 is shown providing an eight bit data output to a d/a converter 40 (FIG. 3) the output of which is amplified by an operational amplifier 41 and supplied to the "COMPEN" terminal of an LM3524 pulse width modulator ic 42 (FIG. 4). The ic 42 control a P-channel enhancement mode MOSFET Q1 which, when switched on, connects a 24V supply to a motor supply bus 43 through the intermediary of an inductor 44. The motor is connected in a bridge formed by two push-pull pairs of MOSFETs Q2, Q3 and Q4, Q5. These four MOSFETs are driven by respective driver transistors Q6, Q7, Q8 and Q9. Transistors Q7 and Q9 are respectively controlled by "LEFT" and "RIGHT" outputs taken from the co-processor 26, so that FETs Q2 and Q5 or FETs Q3 and Q4 are biased to conduct. Transistors Q6 and Q8 are driven from a 40V supply rail so as to ensure that FETs Q2 and Q4 are turned hard on when conductive, thereby ensuring minimum power dissipation in these devices.

The two FETs Q3 and Q4 are connected to the return bus via a current sensing resister RC, which supplies a current related signal to a voltage comparator 45 with hysteresis to provide an input to the A6 input terminal of the co-processor 26 when the current exceeds a predetermined limit. This enables the co-processor to reduce the power applied to the motor to maintain it within safe operating limits.

The optical encoder of the pan motor provides two digital outputs in quadrature, these outputs being cleaned up by interface circuits and applied to two inputs of an HCTL-2016 counter ic 46 intended specifically for use with quadrature type encoders. The counter 46 counts up when the pulses are in one relative phase relationship and down when the opposite phase relationship exists. It therefore maintains a count-state related to the motor shaft position and hence the pan angle of the lamp. This count-state is applied to the C0 to C7 terminals of the coprocessor 26. The co-processor 26 also receives "desired value" data from the main lamp cpu 21, via a 75176 ic 47 (which in fact serves both co-processors 26 and 27). The ic 47 is used to control the transmission or data between the main lamp cpu and the co-processors. Normally the ic 47 is set to receive data from the cpu 21 and pass it to the two co-processors 26 and 27. At power-up or when the main lamp cpu 21 transmits a "break" command, the coprocessor 26 is reset by a circuit 48. The co-processor 26 has a cycle time of 1 mS and on receipt of new data it determines the distance to be traveled and then increases the "desired position" value which is compared with the actual position count by one sixteenth of the required change on each successive iteration of its control loop.

The desired value signals passed from the cpu 21 to the co-processor 26 are also time-sliced, being incremented every 16 mS. When new position data is transmitted to the lamp it is accompanied by data representing the length of time over which the movement is to be spread. The data is received, as mentioned above, in the form of two byte numbers respectively representing the x, y and z co-ordinates of a point in a Cartesian co-ordinate system. During initial setting up of the system, each lamp is sent data which informs its cpu 21 of its position in the co-ordinate system and also of its orientation.

On receipt of a new set of "point at" co-ordinates, the cpu 21 undertakes a "time-slicing" operation to determine how data should be passed to the co-processors 26 and 27. First of all, it determines how many 16 mS loops will take place in the time duration determined by the data contained in the massage received by the lamp and sets up a variable U equal to the reciprocal of this number. A travel variable P is initialized to zero and the total distance to be traveled is determined for each of the pan and tilt movements. Thereafter, on every iteration of the 16 mS loop the travel variable P is incremented by the reciprocal variable U, the result is multiplied by the total travel required and this is added to (or subtracted from) the previous desired value before transmission to the co-processor 26 or 27. When the variable P exceeds unity, the target has been reached.

The message sent to the lamp may include a flag indicating whether travel is to occur in a linear fashion as described above or have a sinusoidal profile imposed on it. In the latter case the value of P is modified as follows: $P'=\sin(2*P)+0.5*(P>0.5)$ the latter term being 0 or 1

The main cpu 26 must next convert the x, y, z values into pan and tilt value data for passing to the co-processors 26 and 27. The cpu first carries out a linear transformation of the absolute x, y, z co-ordinates into co-ordinates x',y',z' relative to the lamp's own frame of reference using the data supplied during initial set up. The ratio of the transformed x' and y' values is calculated as a 16-bit integer, which is used as an index to an ARCTAN table stored in ROM to obtain a value for the desired pan angle. To find the tilt angle, it is first necessary to establish the radial position of the target point in the transformed horizontal plane by calculating the square root of the sum of the squares of the co-ordinates x' and y'. In carrying out this calculation it is necessary to detect an overflow condition which exists if the sum of the squares is a 33 bit number. If this condition is detected, each square is divided by four and a new sum is formed, an overflow flag being set to indicate that overflow has occurred. The square root is found by up to sixteen steps of successive approximation and the result is doubled if the overflow flag was set during the calculation. The resulting square root is divided by the value z' and the result is applied as before to the ARCTAN table to determine the tilt angle. The results obtained represent the new pan and tilt positions to which the lamp is to be moved.

The arrangement described for sending out x, y and z co-ordinate data instead of pan and tilt angle data is highly advantageous in that it enables the console main cpu load to be significantly reduced and also makes it very easy for a console operator to control light beam movements. It is frequently required for a group of lamps to be used together to illuminate a single performer. Where the performer moves from one position on stage to another it is required for all the lamps to change position simultaneously to follow. If the system involved transmission of pan and tilt angle data, this data would be different for every lamp in the group. It would have to be set up by the console operator and stored in cue files on the hard disk drive unit 15. This would be a very time consuming operation as the pan and tilt angles for each lamp would have to be established and recorded individually. The cue record would need to be of considerable size to record all the different data for each lamp. With the arrangement described above, however, only the x, y, z co-ordinate data needs to be stored and when the cue is recalled the same data is sent to each of the lamps in the group.

Whilst it is theoretically possible to use stored cue data in x, y, z co-ordinate form and to use the console main cpu 14 to calculate the pan and tilt angles to send to the lamps, this would be unsatisfactory as the calculations involved would impose a very heavy load on the cpu 14, particularly where a large number of lamps in several different groups had to be moved as the result of a single cue.

As described above, a "point-at" mode is envisaged as the normal operating mode. However, other modes of operation are also envisaged. For example, the lamp could be instructed to point away from the point specified or to point in a direction parallel to a line joining a fixed point (eg the origin of the co-ordinate system) to the point specified. These "point-away" and "point parallel" modes would be selected by means of flags included in the data transmitted to the lamps.

The arrangement described enables the lamps to be very precisely synchronised. The data is transmitted from the distribution unit to all of the lamps simultaneously and each lamp can start to respond at the end of the message. This enables very precise direction of all the lamps to a moving point in "point-at" mode and very clean parallel sweeps to be made in "point parallel" mode.

It should be noted that the use of x, y, z co-ordinates is also very advantageous in situations where a prearranged lighting performance is to be used in several different venues. The pre-loaded gantries or trusses used for such touring performances cannot always be mounted at exactly the required positions relative to the stage because of local conditions. In this case all that is needed is for offsets data to be sent to the lamps at set-up time to enable each lamp cpu to correct its position data. No editing of the individual pre-recorded cues is necessary as it would be in the same circumstances if pan and tilt data were stored.

As part of the set-up procedure for each performance it is necessary to initialize the values of the actual pan and tilt angle count-states, since encoders of the type used do not give any absolute position data. This is accomplished by driving the lamp to an end stop in one direction for each movement. The lamp is driven back to a predetermined number or counts and the counters are reset to zero at this position.

Figure 7:
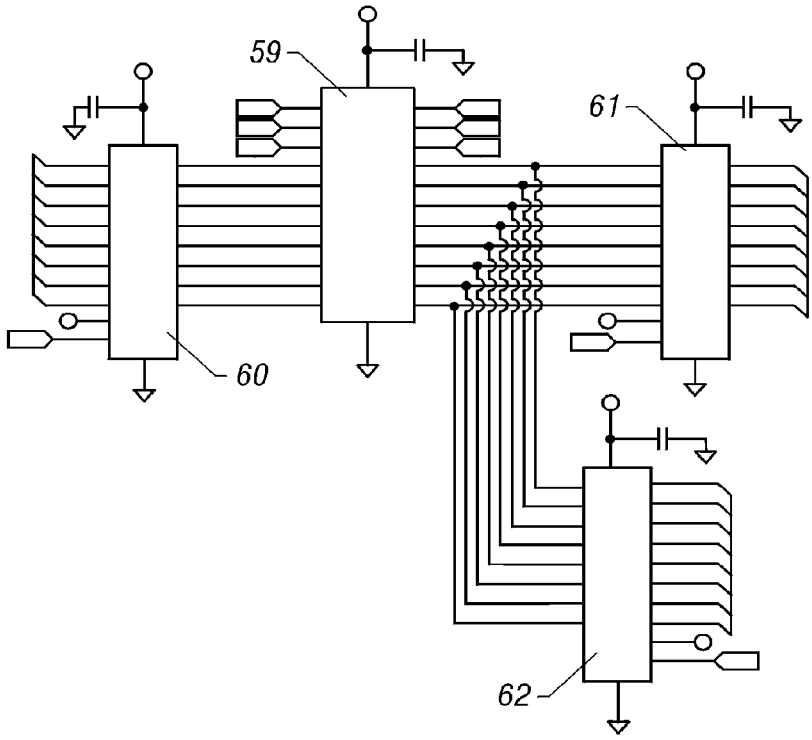
Figure 5:
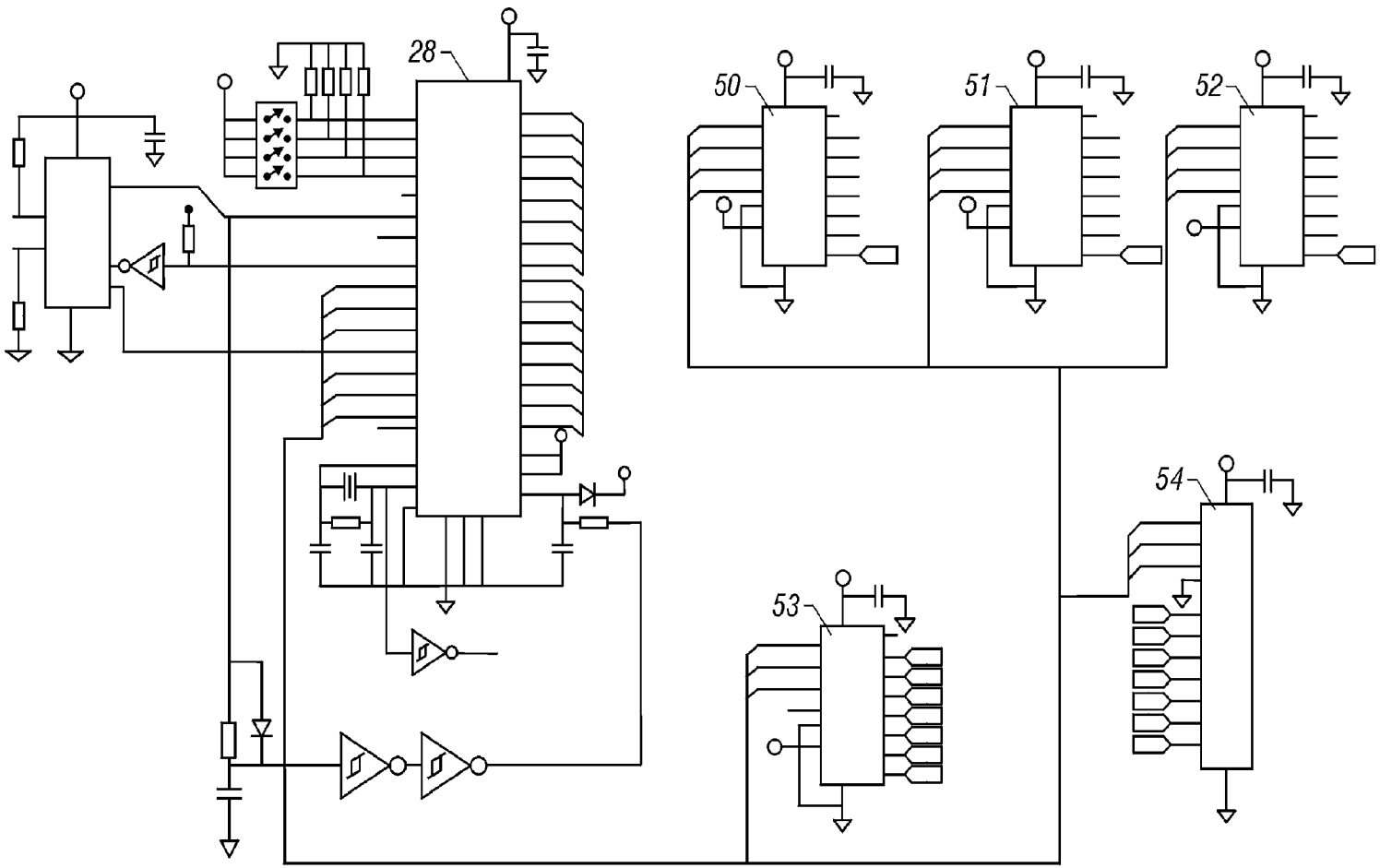
Figure 6:
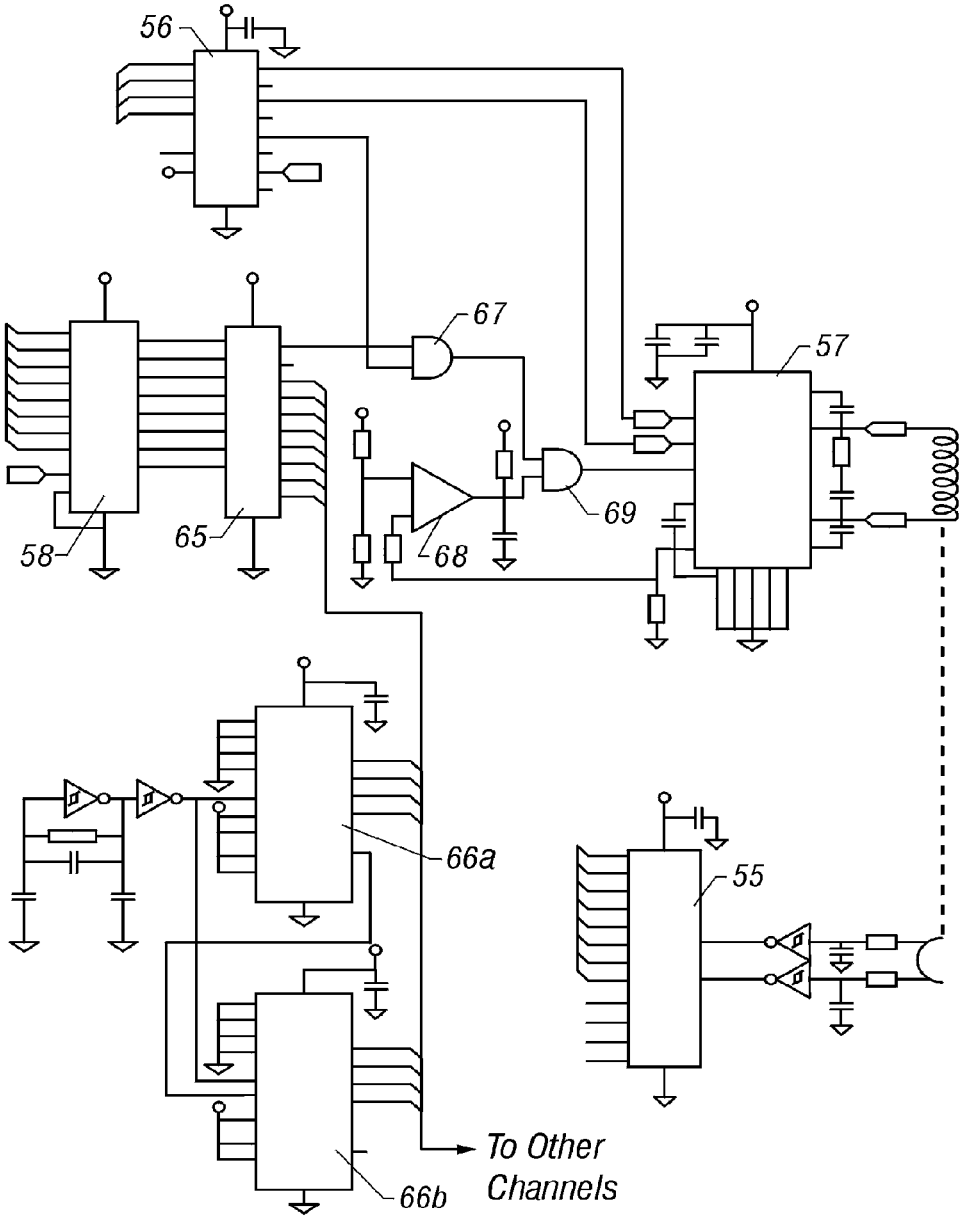

Turning now to FIGS. 5 to 7, the circuitry for controlling the individual dc servo-motors inside the lamp is more complex as each co-processor has to deal with up to six servo-motors. As shown in FIG. 5, the co-processor 28 controls a number of data routers 50 to 54 which determine which channel is being controlled at any given time. The router 50 co-operates with six HCTL-2016 counters 55 which count the quadrature pulse outputs of the respective encoders, to determine which of the counters should supply its count-state to the co-processor 28. Router 51 controls individual resetting of the counters 55. Router 52 co-operates with a 74HC175 ic 56 (one for each channel) to determine which L6202 ic motor controller 57 is enabled and also routes "RIGHT" and "LEFT" signals from the co-processor to the circuits 57. Router 53 controls routing of position error data calculated by the co-processor 28 for each channel to latches 58 (one for each channel) at the input of pulse width modulator circuits for controlling the motor controllers 57. This error data is actually passed to the latch 58 in an inverted form, so that the larger the error, the smaller the value passed is. Router 54 routes various digital sensor signals to a sensor input of the co-processor, such sensors are utilized by some of the channels to indicate when the moving part in question is in a datum position. This is required for the gobo wheels, the colour wheels and the shutter, but not for the iris diaphragms or lenses which can be moved to end stop positions. During datum set-up the sensors (optical sensors sensing a hole or flag or Hall effect sensors) are detected and the HCTL counters are reset.

As co-processor 28 has only 256 bytes of internal memory, extra memory is required for each channel to store program variables. The RAM selection control circuit is shown in FIG. 7. The memory ic 59 (an HN16116LP ic) has 11 address lines of which eight are connected to the co-processor write bus via a latch circuit 60 and the remaining three or which are connected to spare outputs of three of the ics 56. Spare outputs of the selectors 50, 51, 52 are connected to control terminals of the memory ic and a spare output of the selector 53 is connected to an output enable terminal of the latch circuit 59. Thus a particular address in the memory ic can be selected by the co-processor by first setting the ics 56 and the selectors 50, 51, 52 to appropriate states and then outputting the lower bytes of the address to latch 60 whilst output from latch 60 is enabled. Two further eight bit latches 61 and 62 provide temporary storage for data to be written to and data just read from the memory ic 59. When neither reads nor writes are required the memory data bus is tri-stated. Bus contention is thus avoided.

Circuit 57 actually controls the motor current, but it in turn is controlled by a pulse width modulator circuit, comprising the latch 58 and a digital comparator 65 which compares the contents of latch 58 with the count-state of an 8-bit continuously running counter 66*a*, 66*b* serving all channels. The comparator output goes high when the count-state exceeds the latch contents, so that if the latch content is low the comparator output is high for a high proportion of each cycle of the counter 66*a*, 66*b*. The output of the comparator 65 is ANDed with an enable output from ic 56 by a gate 67 and then with the output of an overcurrent detector circuit 68 by another gate 69.

When a new target value for one of the parameters controlled by co-processor 58 arrives in the receive buffer, and it is associated with execution duration data (this may apply to lens movements, colour changer movements, gobo movements and iris diaphragm movements, but not shutter movements) the cpu 21 handles time slicing as in the pan and tilt operations. Since several channels are controlled by each co-processor, however, no interpolation by the coprocessor is used. Instead each channel has its error checked and a new value written (if necessary) to latch 58 every 12 mS.

In the case of the shutter, the message received by the lamp merely includes a shutter open or shutter closed command. When the required shutter status changes, the main cpu merely increases the target shutter angle by 45 degrees (in the case of a four bladed shutter) and passes the new value to the co-processor.

This arrangement enables the shutters of some or all of the lamps to be operated in synchronism. Moreover, the console cpu 14, can operate to update the shutter open/closed instructions at regular intervals to obtain a stroboscopic effect, synchronised for all the lights.

What is claimed is:

1. A method comprising:

storing a plurality of lamp positions on a storage unit in a lamp controlling console, where said lamp positions each are indicative of a current position of a lamp, said lamp positions including a first position which is indicative of a current position of a first lamp, and a second position which is indicative of a current position of a second lamp, wherein said first position is initially indicative of a first initial installed position of said first lamp, and said second position is initially indicative of a second initial installed position of said second lamp, where said first and second initial installed positions are different at different installed locations of said first and second lamps;

first sending first information about a difference between an expected lamp mounting position and an actual lamp mounting position for said first lamp by sending first offset data to said first lamp, and-second sending second information about a difference between an expected lamp mounting position and an actual lamp mounting position for said second lamp by sending second offset data to said second lamp wherein said lamp controlling console is remote from the plurality of lamps whose positions are stored including said first and second lamps, but connected thereto; and using said first and second lamp positions that are stored in said lamp controlling console to control movement of said first and second lamps using prerecorded cues that are set to said expected lamp mounting positions of both said first lamp and said second lamp, sending said prerecorded cues to both said first lamp and said second lamp, whereby said first lamp and said second lamp use said prerecorded cues in conjunction with said first and second offset data to move to desired positions as set in the prerecorded cues by compensating for the difference between an expected lamp mounting position and an actual lamp mounting position.

2. A method as in claim 1, further comprising controlling said first and second lamps to move in synchronization with one another.

3. A method as in claim 2, wherein said using offset data comprises storing offset data in the console, and using the stored offset data along with the stored position.

4. A method as in claim 1, wherein said first and second positions are indicative of positions in x, y and z coordinates.

5. A method as in claim 1, wherein said first changing and said second changing are commanded in a single message, and said first changing and said second changing begin light moving only when both said first changing and said second changing have been sent to said first and said second lights respectively.

6. A method as in claim 1, further comprising determining information indicative of installation in a first venue, and forming and using said first initial installed position of said first lamp and said second initial installed position of said second lamp in said first venue at a first time; and determining information indicative of installation in a second venue, and forming and using said first initial installed position of said first lamp and said second initial installed position of said second lamp in said second venue at a second time.

7. An apparatus, comprising:

a control console, capable of controlling a plurality of lamps including at least first and second lamps, and having a memory which stores data indicative of lamp positions of said lamps, said lamp positions including a first position which is indicative of a current position of a first lamp, and a second position which is indicative of a current position of a second lamp, wherein said first position is initially indicative of a first initial installed position of said first lamp, and said second position is initially indicative of a second initial installed position of said second lamp, where said first and second initial installed positions are different at different installed locations of said first and second lamps;

wherein said control console produces outputs for first correcting said first lamp position by sending first offset data to said first lamp, where said first offset data is indicative between an expected lamp mounting position and an actual lamp mounting position for said first lamp and second correcting said second lamp position by sending second offset data to said second lamp, where said second offset data is indicative of a difference between an expected lamp mounting position and an actual lamp mounting position for said second lamp; and where said first and second positions are changed to change a pointing direction of said lamp, said control console including a connection part adapted for connection to the plurality of lamps, and having a user interface allowing controlling position of the plurality of lamps, an output of the control console that is used for controlling said position responsive to said user interface including information based on said data indicative of said current positions using prerecorded cues that are set to said expected lamp mounting positions of both said first lamp and said second lamp, sending said prerecorded cues to both said first lamp and said second lamp, whereby said first lamp and said second lamp use said prerecorded cues in conjunction with said first and second offset data to move to desired positions as set in the prerecorded cues by compensating for the difference between an expected lamp mounting position and an actual lamp mounting position.

8. An apparatus as in claim 7, wherein said control console controls both of said first and second lamps in synchronization with one another.

9. An apparatus as in claim 7, wherein said first and second positions are indicative of positions in x, y and z coordinates.

10. An apparatus as in claim 7, wherein said control console operates to correct by sending information indicative of said difference to said lamps, as a command to move said lamps.

11. An apparatus as in claim 7, wherein said first changing and said second changing are commanded in a single message, and said first changing and said second changing begin light moving only when both said first changing and said second changing have been sent to said first and said second lights respectively.

12. An apparatus as in claim 7, wherein said console determining information indicative of installation in a first venue, and forming and using said first initial installed position of said first lamp and said second initial installed position of said second lamp in said first venue at a first time; and determining information indicative of installation in a second venue, and forming and using said first initial installed position of said first lamp and said second initial installed position of said second lamp in said second venue at a second time.

13. A method, comprising:

using a remote control console for operating a first stage lighting unit that forms an output light beam from an internal light source into a beam, and to control a first rotary shutter device in said first stage lighting unit, said first rotary shutter device having a plurality of blades, said first shutter device being rotatably mounted to cause said blades to pass through and obstruct said internal light source, to obstruct said beam as the shutter device rotates, said remote control console controlling said first rotary shutter by sending data to said first stage lighting unit;

using said remote control console for operating a second stage lighting unit that forms an output light beam from an internal light source into a beam, and to control a second rotary shutter device in said second stage lighting unit, said second rotary shutter device having a plurality of blades, said second shutter device being rotatably mounted to cause said blades to pass through and obstruct said internal light source, to obstruct said beam as the shutter device rotates, said remote control console controlling said second rotary shutter by sending data to said second stage lighting unit;

wherein said using controls the rotary shutter devices of both of said first and second units to operate in synchronism with one another, so that both of said rotary shutter devices produce effects which are synchronized between both of said first and second stage lighting unit.

14. A method as in claim 13 comprising:

storing a plurality of lamp positions on a storage unit in said remote control console, where said lamp positions each are indicative of a current position of a lamp, said lamp positions including a first position which is indicative of a current position of said first lamp, and a second position which is indicative of a current position of said second lamp, wherein said first position is initially indicative of a first initial installed position of said first lamp, and said second position is initially indicative of a second initial installed position of said second lamp, where said first and second initial installed positions are different at different installed locations of said first and second lamps.

15. A method as in claim 14, further comprising:

first changing said first lamp position from a first current lamp position to a new first lamp position, by sending first offset data to said first lamp, where said first offset data indicates a desired difference between said first current lamp position and said new first lamp position, and said first offset data does not include absolute information about said new first lamp position; and second changing said second lamp position from a second current lamp position to a new second lamp position, by sending second offset data to said second lamp, where said second offset data is indicative of a desired difference between said second current lamp position and said new second lamp position, and does not include absolute information about said new second lamp position.

16. A method as in claim 14, wherein said first and second positions are indicative of positions in x, y and z coordinates.

17. A method as in claim 14, wherein said first changing and said second changing are commanded in a single message, and said first changing and said second changing begin light moving only when both said first changing and said second changing have been sent to said first and said second lights respectively.

18. A method as in claim 13, further comprising determining information indicative of installation in a first venue, and forming and using said first initial installed position of said first lamp and said second initial installed position of said second lamp in said first venue at a first time; and determining information indicative of installation in a second venue, and forming and using said first initial installed position of said first lamp and said second initial installed position of said second lamp in said second venue at a second time.

* * * * *